US006591935B1

(12) United States Patent
Petley

(10) Patent No.: US 6,591,935 B1
(45) Date of Patent: Jul. 15, 2003

(54) ATV STEALTH EXHAUST SYSTEM

(76) Inventor: Gary L. Petley, 1130 Donegal St., Casper, WY (US) 82609

( * ) Notice: Subject to any disclaimer, the term of this patent is extended or adjusted under 35 U.S.C. 154(b) by 0 days.

(21) Appl. No.: 09/907,189

(22) Filed: Jul. 17, 2001

Related U.S. Application Data

(60) Provisional application No. 60/218,517, filed on Jul. 17, 2000.

(51) Int. Cl.[7] ..... B60K 13/04; F16L 3/04; F01N 7/08

(52) U.S. Cl. ..... 180/309; 285/253; 181/228

(58) Field of Search ..... 180/309, 89.2; 181/231, 227, 228; 285/253, 903, 420, 226, 49

(56) References Cited

U.S. PATENT DOCUMENTS

| | | | | | |
|---|---|---|---|---|---|
| 1,015,955 | A | | 1/1912 | Helder | |
| 1,021,254 | A | | 3/1912 | Larkins | |
| 3,752,260 | A | * | 8/1973 | Heath | 180/309 |
| 3,847,184 | A | * | 11/1974 | God | 138/121 |
| 3,972,384 | A | | 8/1976 | Hoefs | |
| 4,147,230 | A | * | 4/1979 | Ormond et al. | 181/231 |
| 4,222,456 | A | * | 9/1980 | Kasper | 181/231 |
| 4,345,430 | A | * | 8/1982 | Pallo et al. | 180/309 |
| 4,415,188 | A | * | 11/1983 | Ginter, Jr. | 285/420 |
| 4,537,280 | A | * | 8/1985 | Roberts | 180/309 |
| 4,573,550 | A | * | 3/1986 | Inomata et al. | 180/309 |
| 4,683,917 | A | * | 8/1987 | Bartholomew | 138/121 |
| 4,955,193 | A | * | 9/1990 | Hoeptner, III | 60/320 |
| 4,966,253 | A | * | 10/1990 | Stephens et al. | 181/227 |
| 4,998,597 | A | * | 3/1991 | Bainbridge et al. | 181/243 |
| 5,245,140 | A | | 9/1993 | Wu | |
| 5,509,947 | A | * | 4/1996 | Burton | 55/276 |
| 5,708,238 | A | * | 1/1998 | Asao et al. | 181/272 |
| 5,726,397 | A | | 3/1998 | Mikai et al. | |
| 5,898,140 | A | * | 4/1999 | Asao et al. | 181/272 |
| 5,961,153 | A | * | 10/1999 | Foster | 285/15 |
| 6,394,225 | B1 | * | 5/2002 | Yasuda | 181/256 |
| 6,438,949 | B1 | * | 8/2002 | Nozaki | 60/322 |

* cited by examiner

*Primary Examiner*—Brian L. Johnson
*Assistant Examiner*—Jeffrey J Restifo
(74) *Attorney, Agent, or Firm*—Jon Carl Gealow

(57) ABSTRACT

An exhaust modification system for an all terrain vehicle which reduces the exhaust noise of the vehicle and reduces the possibility of hot particles being discharged with the exhaust gas so as to ignite readily combustible material upon which the particle might land. The exhaust modification system includes a muffler, at least two length of flexible exhaust pipe, exhaust pipe clamps, and mounting brackets for suspending the muffler from the all terrain vehicle.

22 Claims, 8 Drawing Sheets

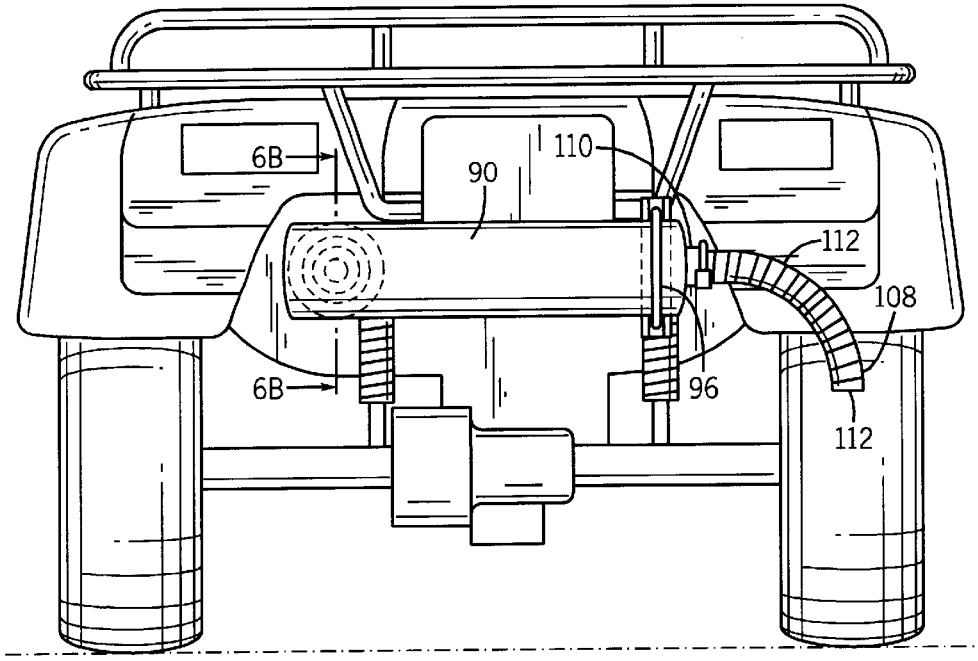
FIG. 6A
FIG. 7A
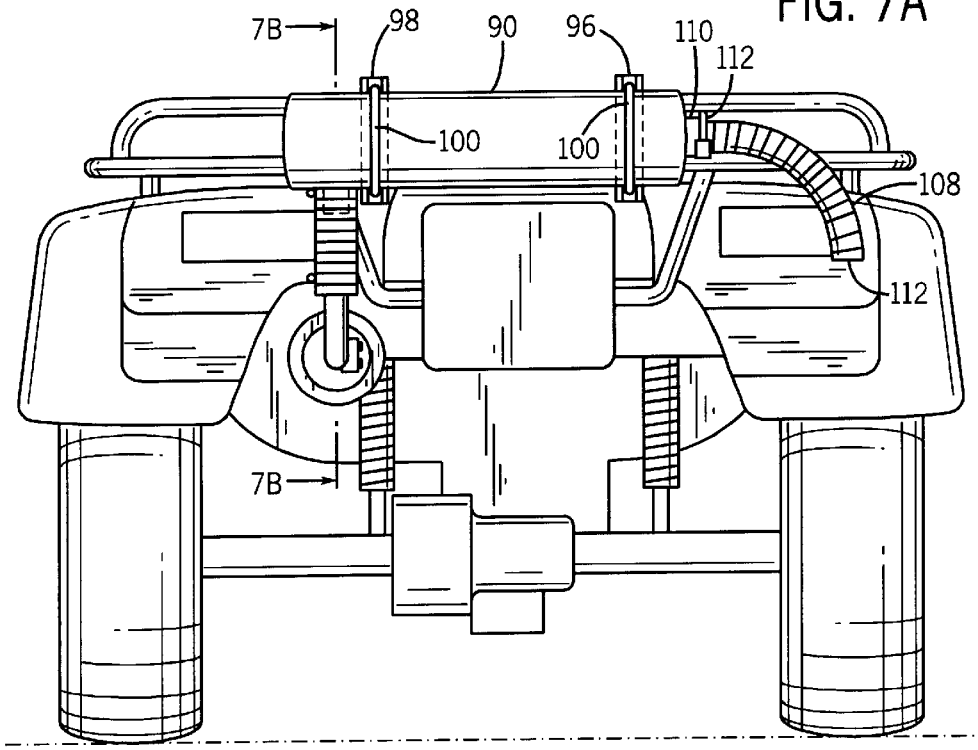

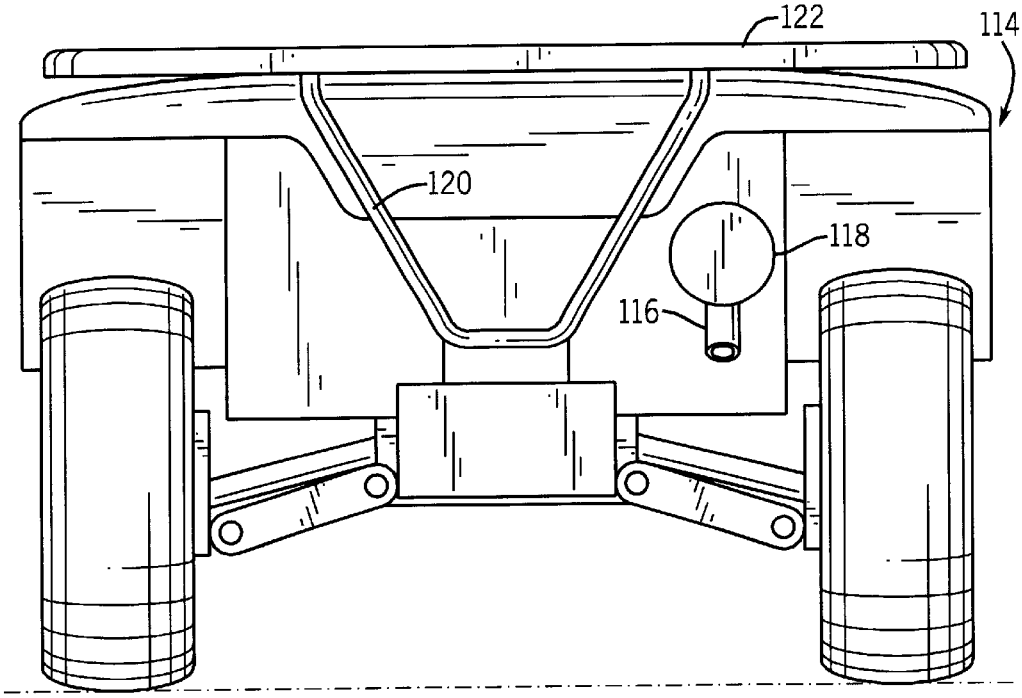
FIG. 8A
PRIOR ART
FIG. 8B
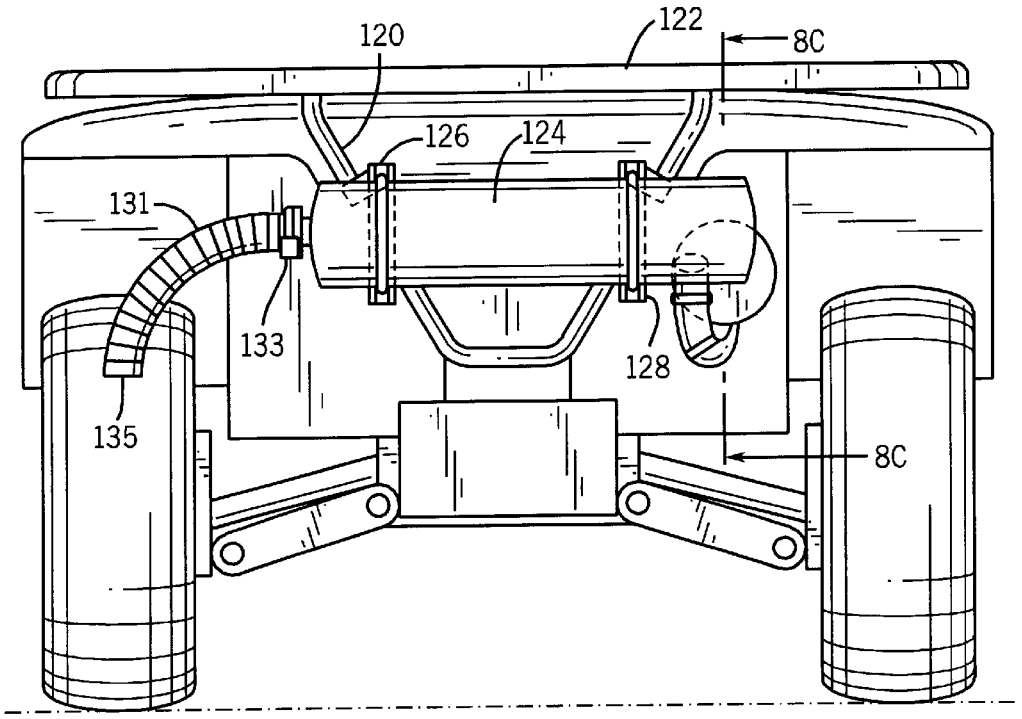

ATV STEALTH EXHAUST SYSTEM

CROSS REFERENCE TO RELATED APPLICATIONS

This application claims the benefit of prior filed copending provisional application No. 60/218,517, filed Jul. 17, 2000, entitled: ATV Stealth Exhaust System.

FIELD OF THE INVENTION

The present invention relates to the exhaust systems for all terrain vehicles. More particularly it relates to four wheel vehicles of the type used for off-road travel for both recreational and work purposes.

BACKGROUND OF THE INVENTION

Four wheel all terrain vehicles, typically referred to as ATV's are currently offered for sale by several manufacturers. ATV's appeared to have developed as an alternative to off-road motorcycles. As in the case of off-road motorcycles, they are of a rugged design, intended to withstand operation on very rough surfaces, even when traveling at relatively fast speeds. As is true with motorcycles, they are typically provided with a muffler system which is not very effective at reducing the noise caused by the exhaust of the engine. Just as the owners or riders of motorcycles, desired or preferred a greater sound level from the exhaust system then is typically the case with an automobile, so have ATV owners and riders. The more direct flow of exhaust gases through the usual mufflers on motorcycles and ATVs is more likely to permit hot solid particles to be released from the mufflers, which upon landing upon a combustible material could result in a fire.

Owners and riders are now finding new uses and therefor have new requirements for their ATVs. For instance, ATV owners and riders having a desire to use their vehicles on public lands, such as state and national parks, are meeting resistance to their use because of the exhaust noise of a stock ATV and because of the possibility of hot particles in the exhaust gases starting fires. Further some ATV owners and riders desire to use their ATVs for quietly approaching wildlife for the purpose of observation or hunting. Others desire to use their ATVs in ranching operations, where the load noise of stock ATV mufflers startles cattle thereby making it more difficult to approach them.

Accordingly, it would be advantageous to provide a arrangement whereby ATVs produced by several different manufactures could be readily equipped with an exhaust modification system for reducing the exhaust noise and likelihood of hot particles being emitted to the atmosphere in the exhaust gas. It would be of further advantage to provide an exhaust modification system, comprising a number of components, provided as a kit, which is adaptable for use with the stock exhaust system of ATVs produced by a plurality of different manufactures, and ATVs of the same manufacturer which are provided with different equipment.

SUMMARY OF THE INVENTION

It is an object of this invention to provide an exhaust modification system adaptable for use with the stock exhaust systems of ATVs to reduce the exhaust noise and the likelihood of hot particles being emitted to the atmosphere in the exhaust gas of the ATVs. It is a further object of this invention to provide an exhaust modification system comprising a number of components, provided as a kit, which is adaptable for use with stock exhaust systems of ATVs produced by a plurality of different manufactures, and ATVs of the same manufacturer which are provided with different accessories, to reduce the exhaust noise and the likelihood of hot particles being emitted to the atmosphere in the exhaust gas of the ATVs.

An exhaust modification system for use with the stock exhaust systems of ATVs to reduce the exhaust noise and the likelihood of hot particles being emitted to the atmosphere in the exhaust gas of the ATVs in accordance with this invention comprises a muffler, a plurality of exhaust pipes, connecting adaptors, and mounting and clamping devices.

BRIEF DESCRIPTION OF THE DRAWINGS

FIG. 6A is a perspective view of the rear end of the ATV shown in FIG. 5, provided with the exhaust modification system of this invention in a first mounting arrangement;

FIG. 7A is a perspective view of the rear end of the ATV shown in FIG. 5, provided with the exhaust modification system of this invention in a second mounting arrangement;

FIG. 8A is a perspective view of the rear end of an ATV of a third manufacturer showing the muffler and outlet of the stock exhaust system;

FIG. 8B is a perspective view of the rear end of the ATV shown in FIG. 8A, provided with the exhaust modification system of this invention;

DETAILED DESCRIPTION OF THE PREFERRED EMBODIMENT

Figure 1:
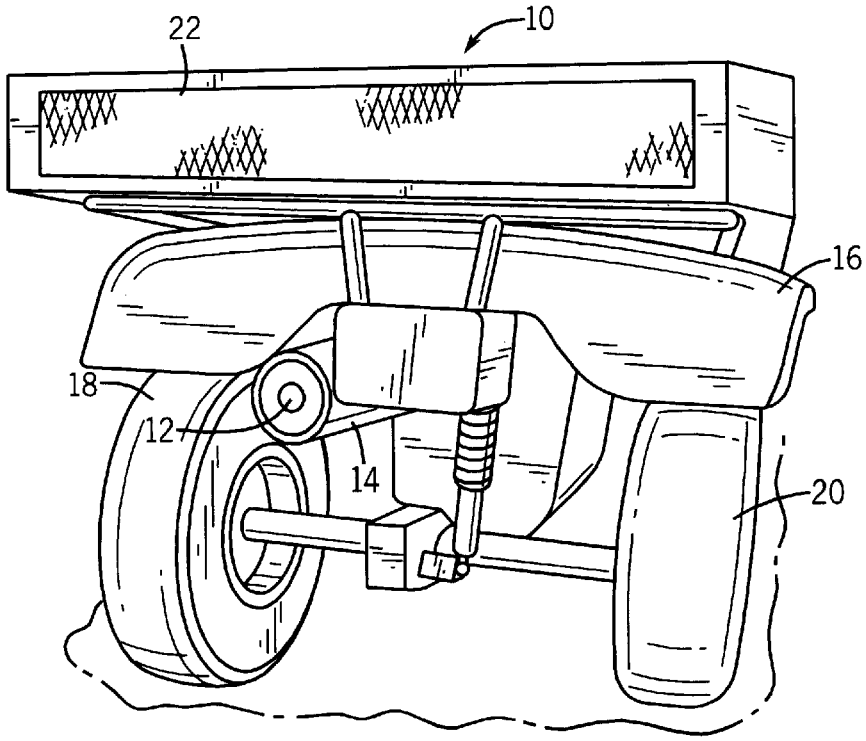
FIG. 1 PRIOR ART
FIG. 1 is a perspective view of the rear end of an ATV of a first manufacturer showing the muffler and outlet of the stock exhaust system.

Referring to FIG. 1, the rear end of an ATV 10 of a first manufacturer is shown. The exhaust gas from the stock exhaust system of this ATV is discharged from a rearwardly facing opening 12 in the stock muffler 14. The stock muffler 14 is suspending beneath the fender 16 positioned over the rear drive wheels 18 and 20, and inside the left rear drive wheel 18. A basket 22, for carrying sundry articles is supported over the fender 16. The exhaust modification system of this invention is supported from and beneath the basket 22 as shown in FIG. 2.

Figure 2:
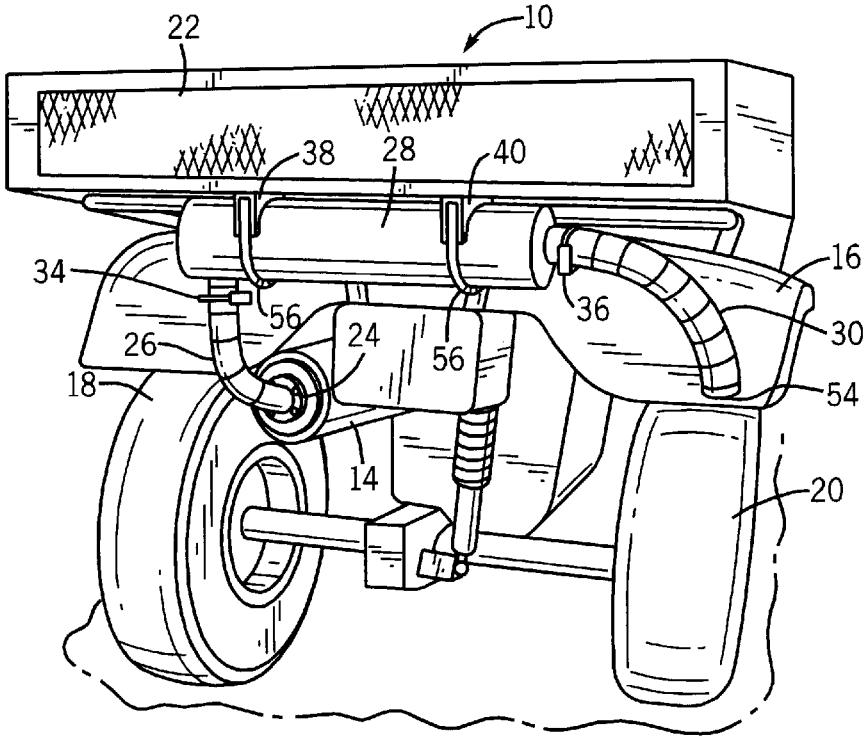
FIG. 2 is a perspective view of the rear end of the ATV shown in FIG. 1, provided with the exhaust modification system of this invention.
Figure 3:
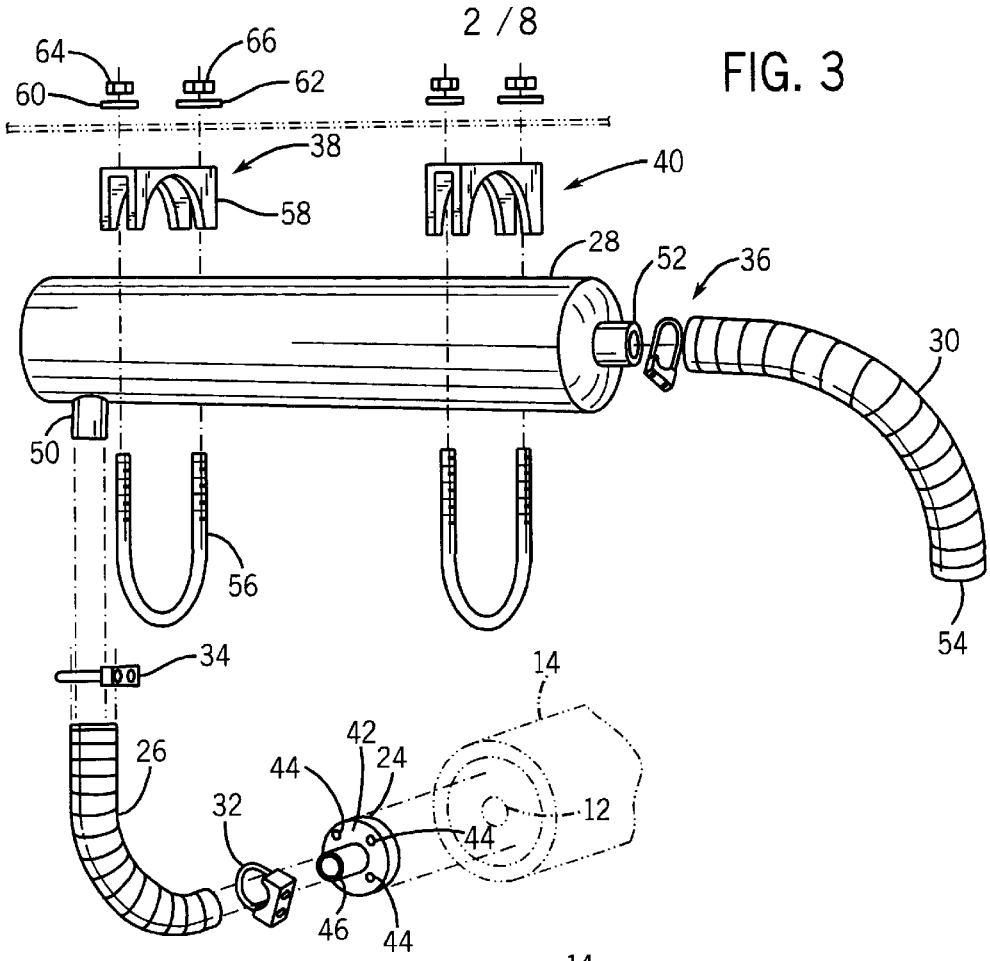
FIG. 3 is an exploded perspective view of the exhaust modification system of this invention as shown installed on an ATV in FIG. 2.

Referring to FIG. 3, the components of an exhaust modification system in accordance with this invention are shown in an exploded perspective view positioned as they would be for installation on the ATV as shown in FIG. 2. The exhaust modification system includes an adaptor 24, a first length of flexible exhaust pipe 26, a muffler 28, a second length of flexible exhaust pipe 30, clamps 32, 34, and 36 for securing the lengths of flexible pipe 26 and 30, and muffler mounting clamps 38 and 40. The muffler 28 is an efficient, super quiet, yet high flow muffler. The muffler may reduce exhaust noise by up to 50 percent, while at the same time not having any adverse affects on the engine, such as loss of performance.

Figure 4:
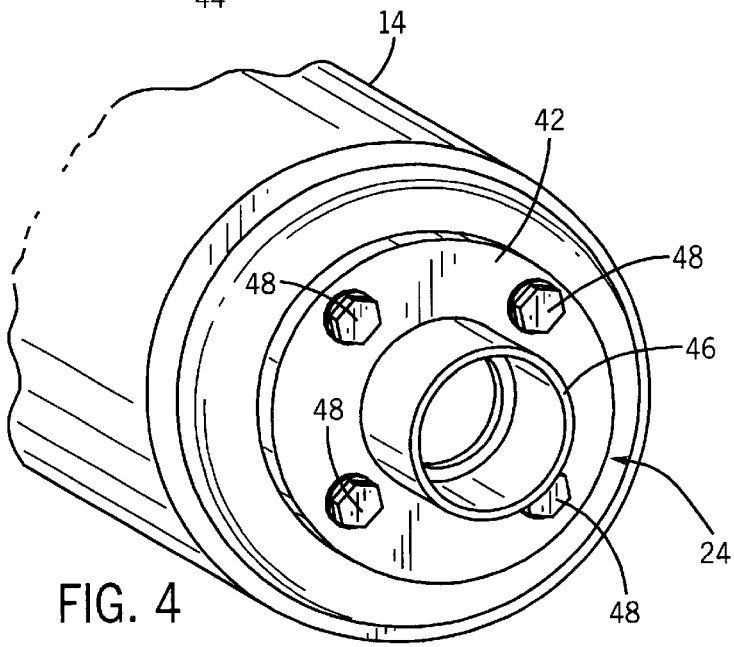
FIG. 4 is a perspective view of the exhaust end of the stock muffler of the ATV shown in FIGS. 1 and 2, with an adaptor flange installed on the stock muffler.

Since the stock muffler 14 as shown in FIG. 1, is not provided with an outlet pipe, the exhaust modification system of this invention includes the adaptor 24 formed with a cylindrical flange 42, having mounting holes 44 formed therein, and a cylindrical pipe extension 46 extending from a hole in the center of the flange. The flange 42 is secured to the stock muffler 14 with the cylindrical pipe extension 46 in line with the rearwardly facing opening 12 in the stock muffler 14. To instal the exhaust modification system of this invention, holes are formed in the stock muffler 14 in line with the mounting holes 44, to receive fastening devices, such as sheet metal screws 48, the heads of which are shown in FIG. 4, or rivets, to secure the mounting flange 42 to the stock muffler 14. However, if welding equipment is available, the mounting flange or a bushing may be welded to the stock muffler.

The exhaust modification system muffler 28, is provided with an inlet 50 on the cylindrical sidewall of the muffler near a first end of the muffler, and an outlet 52 at the center of the second end of the muffler. The inlet and outlet are each formed as cylindrical pipe stubs. A first end of first length of flexible exhaust pipe 26 is secured to cylindrical pipe extension 46 by pipe clamp 32, while the second end of first length of flexible exhaust pipe 26 is secured to the cylindrical pipe stub of inlet 50 of the exhaust modification system muffler 28 by pipe clamp 34. A first end of second length of flexible exhaust pipe 30 is secured to the cylindrical pipe stub of outlet 52 of the exhaust modification system muffler 28 by pipe clamp 36. The second length of flexible exhaust pipe 30 is bend, such that second end 54 faces downward. It has been found that having the open end of the exhaust pipe 30 between 18 and 24 inches from the ground is most desirable from the point of view of further reducing exhaust noise. While having the open end closer to the ground further reduces noise, from an operational viewpoint, it should not be closer than 18 inches.

Generally, the use of two lengths of flexible exhaust pipe in the exhaust modification system is preferred, since it can usually be pushed back into the desired shape if it is bend by bumped or hit by some object.

The exhaust modification system muffler 28 is secured to the bottom of the basket 22 by muffler mounting clamps 38 and 40. The muffler clamp 38 includes a u-bolt 56, a saddle 58 and lock washers 60 and 62 and nuts 64 and 66. Holes are provided in the bottom of the basket 22 to receive the threaded ends of u-bolt 56. The muffler clamp 40 is similar to muffler clamp 38.

Figure 5:
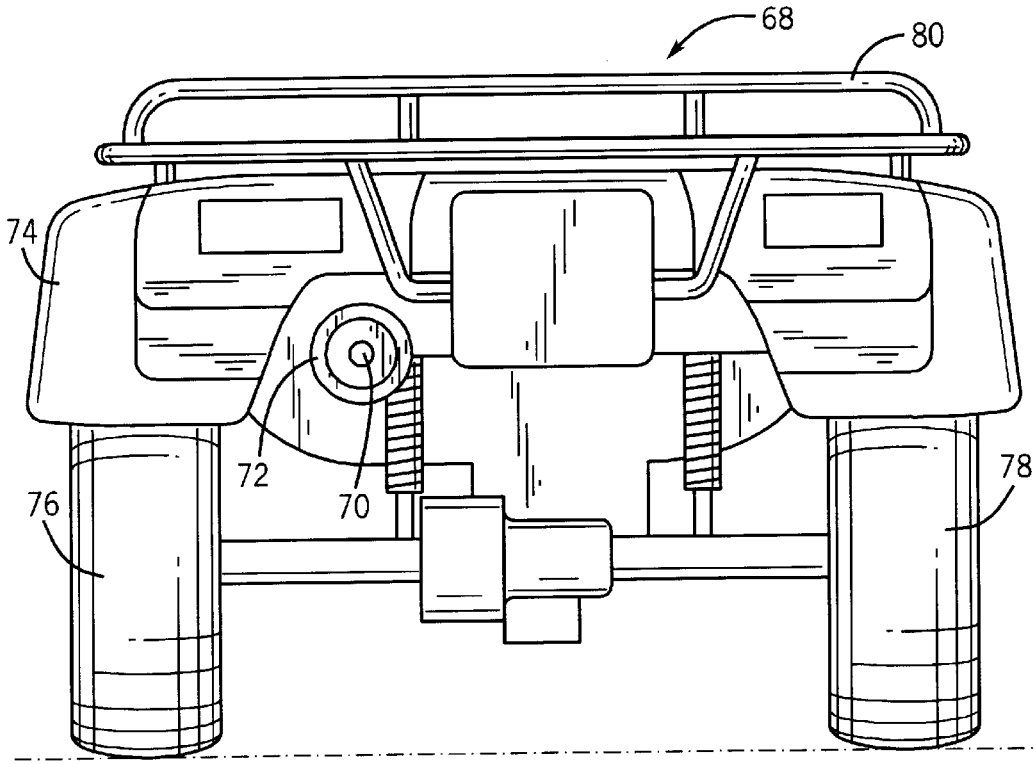
FIG. 5 PRIOR ART
FIG. 5 is a perspective view of the rear end of an ATV of a second manufacturer showing the muffler and outlet of the stock exhaust system.

Referring to FIG. 5, the rear end of an ATV 68 of a second manufacturer is shown. The exhaust gas from the stock exhaust system of this ATV is discharged from a rearwardly facing opening 70 in the stock muffler 72. The stock muffler 72 is suspending beneath the fender 74 positioned over the rear drive wheels 76 and 78, and inside the left rear drive wheel 76. A framework 80, is supported over the fender 74. The exhaust modification system of this invention may be supported from framework 80 in either of two positions, a low position as shown in FIG. 6A, and a high position as shown in FIG. 7A.

Figure 6B:
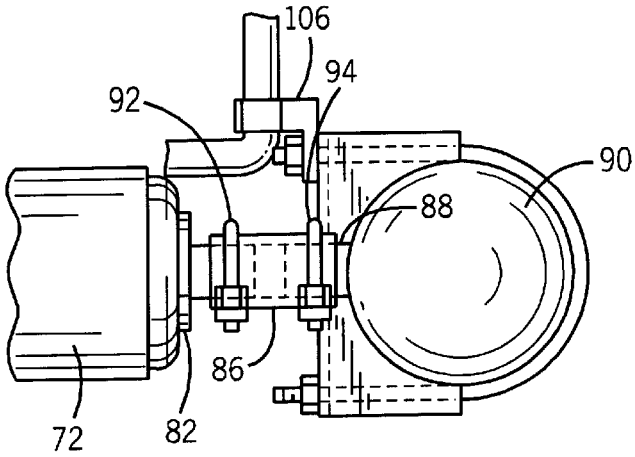
FIG. 6B is a side plan view showing the connection and support between the stock muffler and the exhaust modification system of this invention as shown in FIG. 6.
Figure 7B:
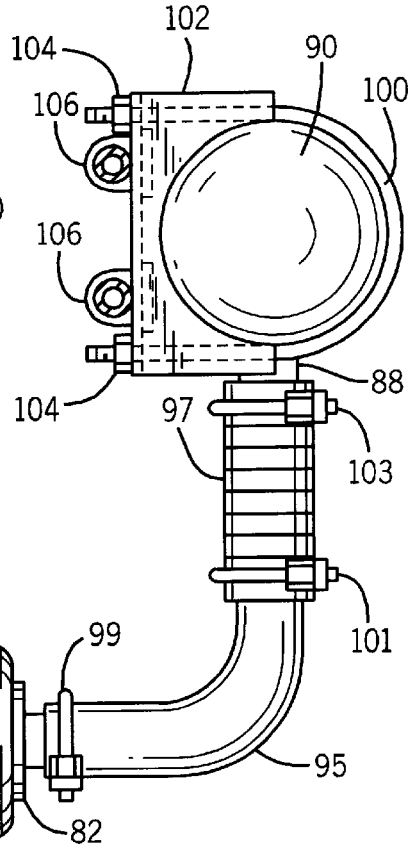
FIG. 7B is a side plan view showing the connection and support between the stock muffler and the exhaust modification system of this invention as shown in FIG. 7.

As in the embodiment shown in FIGS. 1–4, the exhaust modification system shown installed in FIGS. 6A and 7A on the ATV 68 shown in FIG. 5, includes the same components as the exhaust modification system shown in FIG. 3, and installed on an ATV as shown in FIG. 2. As shown in FIGS. 6B and 7B an adaptor 82 is installed over the outlet of the stock muffler 72. For the low position shown in FIGS. 6A and 6B, a short coupling pipe 86 is connected between the adaptor 82 and the inlet 88 of exhaust modification system muffler 90, and is secured by clamps 92 and 94. For the high position, the adaptor 82 is connected to the inlet of the exhaust modification system muffler 90 by an elbow pipe 95 and a length of flexible exhaust pipe 97. The connections between the adaptor 82 and elbow pipe 95, between the elbow pipe 95 and the flexible exhaust pipe 97, and between the flexible exhaust pipe 97 and the inlet of the exhaust modification system muffler 90, are secured by clamps, 99, 101, and 103. The exhaust modification system muffler 90 is secured to the framework 80 by one or a pair of muffler clamps 96 and 98, each of which includes a u-bolt 100, a saddle 102 and nuts 104, and L-shaped brackets 106. One leg of each L-shaped bracket is secured to one of the muffler clamps, and the other is secured to the framework. As shown in FIGS. 6A and 7A, a first end of length of flexible exhaust pipe 108 is secured to the cylindrical pipe stub of outlet 110 of the exhaust modification system muffler 90 by a pipe clamp 112. The flexible exhaust pipe 108 is bend, such that second end 112 faces downward.

Figure 8C:
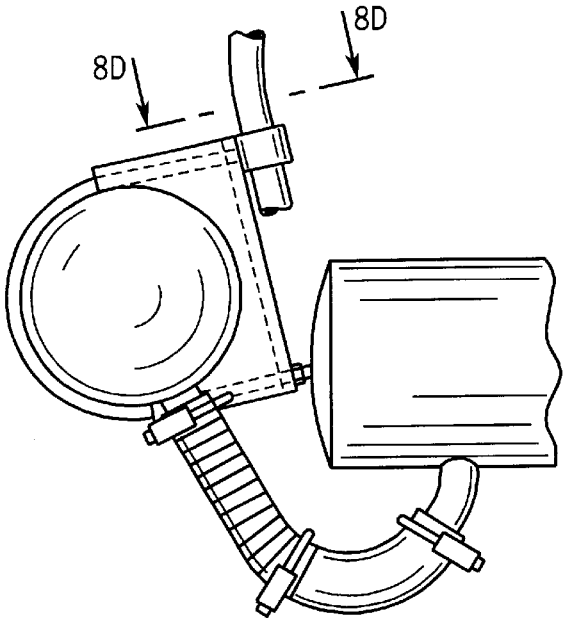
FIG. 8C is a side plan view showing the connection and support between the stock muffler and the exhaust modification system of this invention as shown in FIG. 8B.
Figure 8D:
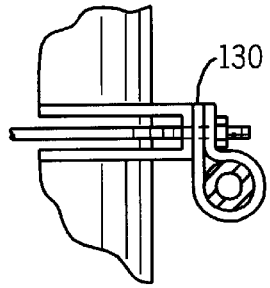
FIG. 8D is a cross-sectional view taken along the line 8D—8D in FIG. 8C.

Referring to FIG. 8A, the rear end of an ATV 114 of a third manufacturer is shown. The exhaust gas from the stock exhaust system of this ATV is discharged from a downwardly facing pipe 116 of the stock muffler 118. As in the previously described embodiments, the stock muffler 118 is suspending beneath the fender positioned over the rear drive wheels, and is positioned inwardly from the right rear drive wheel. A trapezoidal shaped frame 120 extends downwardly at the rear of the vehicle from a deck 122 positioned over the fenders of the ATV. As shown in FIG. 8B, the exhaust modification system muffler 124 is secured to two legs of the trapezoidal shaped frame 120 by a pair of muffler clamps 126 and 128. Referring to FIG. 8C, the connection between the stock muffler and the exhaust modification muffler is similar to that shown in FIG. 7B, in that it includes an elbow and a length of flexible exhaust pipe. FIG. 8D shows one of the bracket 130 which is secured to the muffler clamp and the leg of the trapezoidal shaped frame 120. As shown in FIG. 8B, a first end of length of flexible exhaust pipe 131 is secured to the cylindrical pipe stub of the outlet of the exhaust modification system muffler 124 by a pipe clamp 133. The flexible exhaust pipe 131 is bend, such that second end 135 faces downward.

Figure 9C:
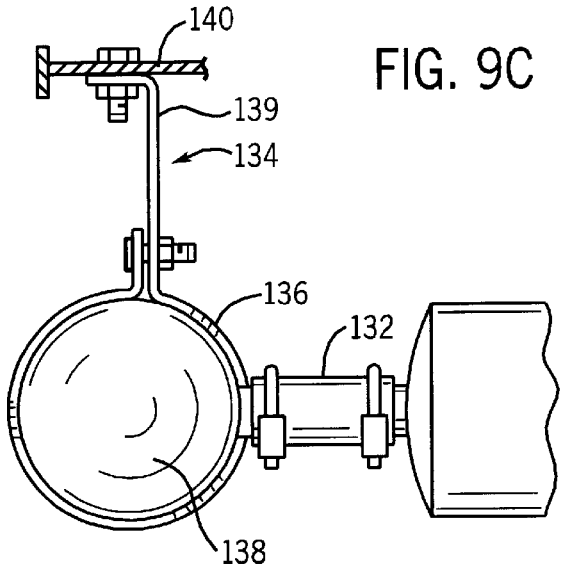
FIG. 9C is a side plan view showing the connection and support between the stock muffler and the exhaust modification system of this invention as shown in FIG. 9B.
Figure 9A:
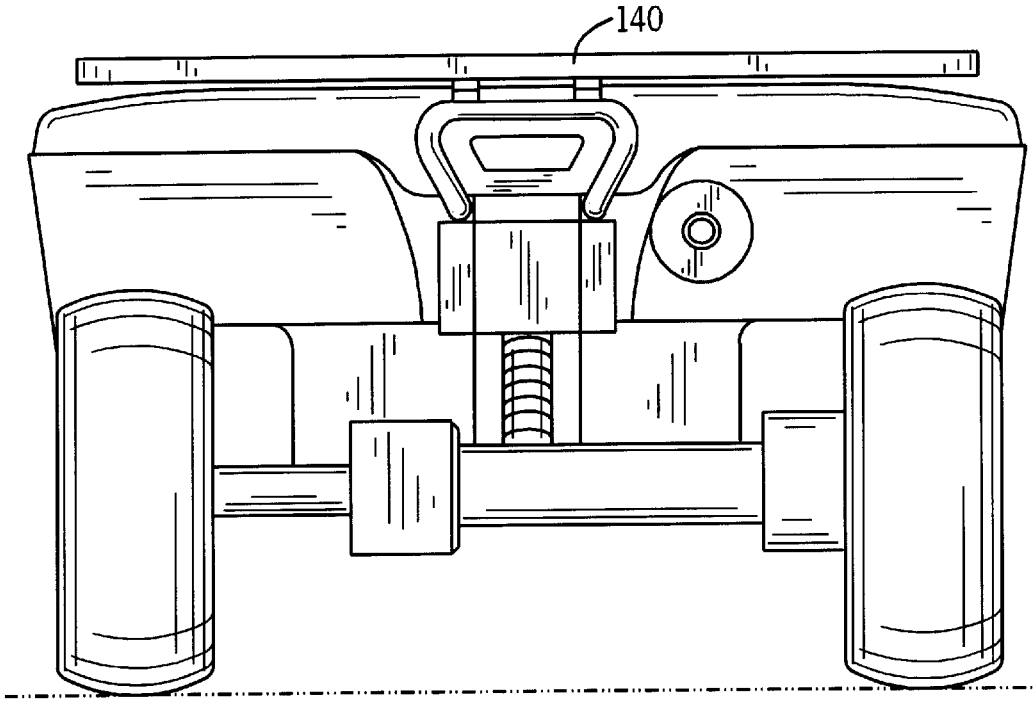
FIG. 9A PRIOR ART
FIG. 9A is a perspective view of the rear end of an ATV of a fourth manufacturer showing the muffler and outlet of the stock exhaust system.
Figure 9B:
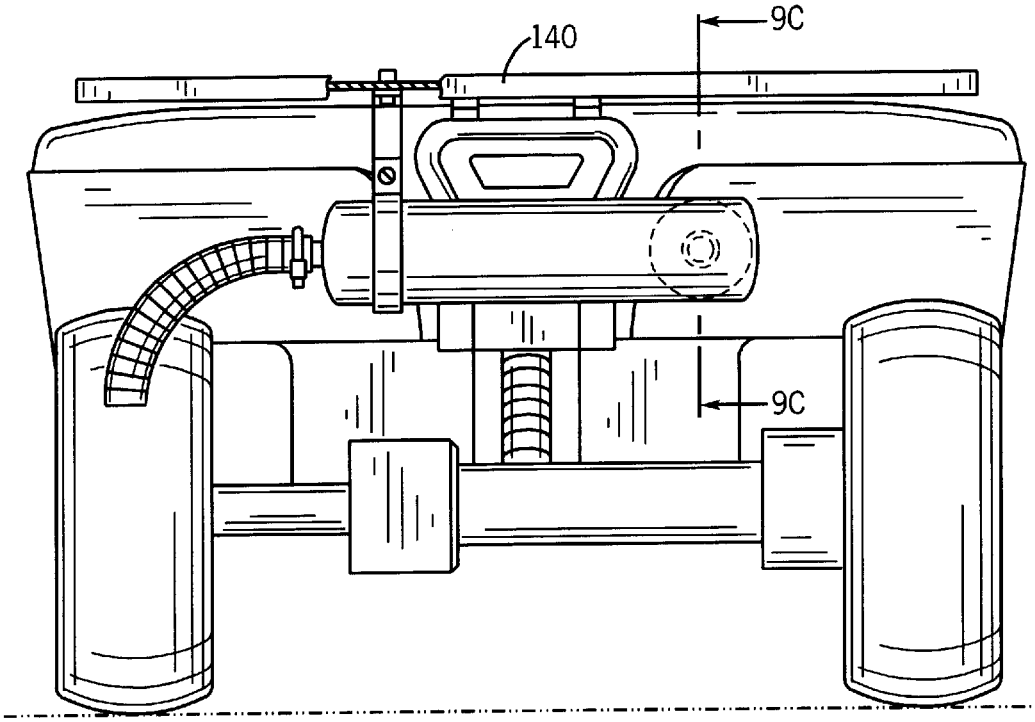
FIG. 9B is a perspective view of the rear end of the ATV shown in FIG. 9A, provided with the exhaust modification system of this invention.

Another ATV is shown in FIG. 9A without the exhaust modification system of this invention, and with the exhaust modification system of this invention in FIG. 9B. In this embodiment, as shown in FIG. 9C, only a short straight piece of pipe 132 is required between the outlet of the stock muffler and the inlet of the exhaust modification muffler. A bracket 134 includes a circular portion 136 clamped around the exhaust modification muffler 138, and an L-shaped portion 134, one leg of which is secured to a deck 140 positioned over the fender of the ATV.

Figure 10C:
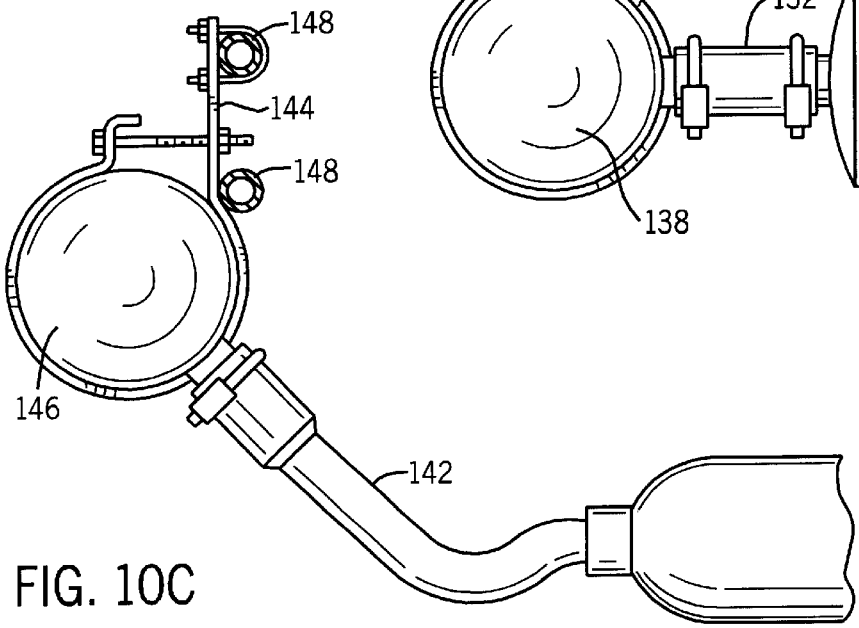
FIG. 10C is a side plan view showing the connection and support between the stock muffler and the exhaust modification system of this invention as shown in FIG. 10B.
Figure 10A:
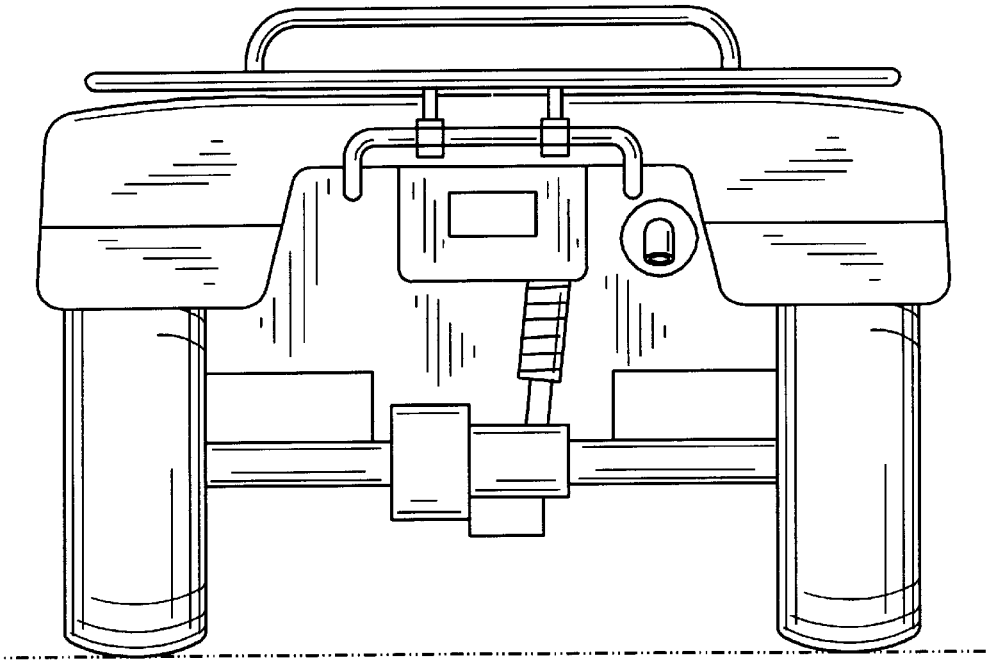
FIG. 10A PRIOR ART
FIG. 10A is a perspective view of the rear end of an ATV of a fifth manufacturer showing the muffler and outlet of the stock exhaust system.
Figure 10B:
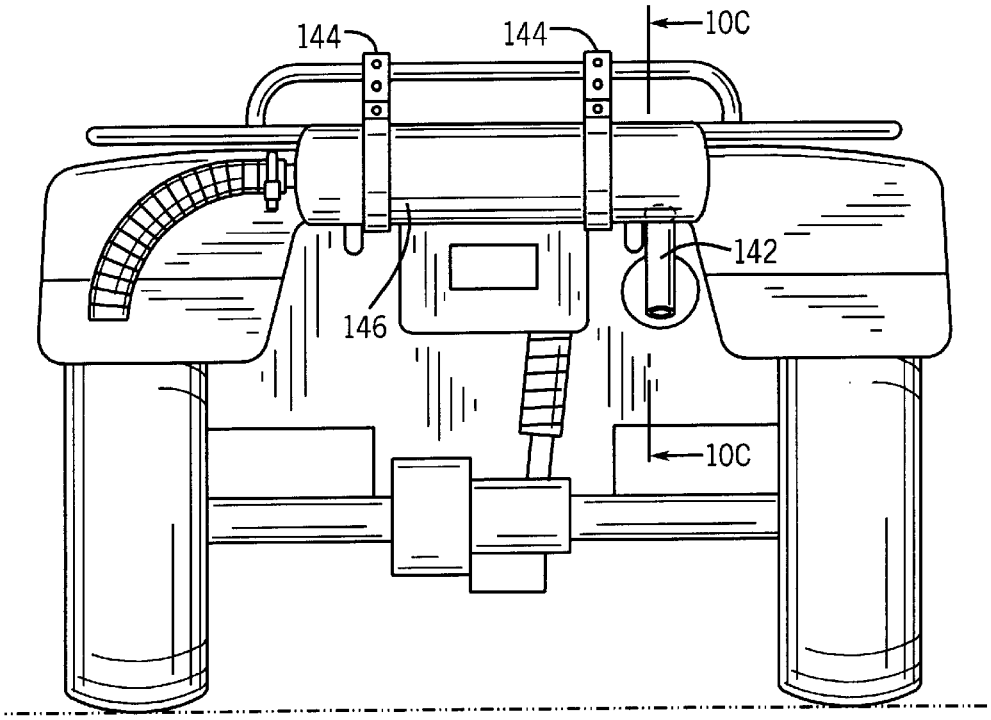
FIG. 10B is a perspective view of the rear end of the ATV shown in FIG. 10A, provided with the exhaust modification system of this invention.

Still another ATV is shown in FIG. 10A without the exhaust modification system of this invention, and with the exhaust modification system of this invention in FIG. 10B. In this embodiment, a preformed piece of pipe 142, as shown in FIG. 10C, is connected between the outlet of the stock muffler and the inlet of the exhaust modification muffler. A pair of brackets 144 support the exhaust modification muffler 146 from a tubular frame member 148 located above the rear fender of the ATV.

While several applications of the exhaust modification system of this invention have been shown, it should be apparent to those skilled in the art that what have been described are considered at present to be preferred application of the exhaust modification system of this invention. In accordance with the Patent Statute, changes and modifications may be made in the exhaust modification system and its application to ATVs without actually departing from the true spirit and scope of this invention. The appended claims are intended to cover all such changes and modification which fall in the true spirit and scope of this invention.

What is claimed is:

1. An exhaust modification system for an all terrain vehicle having a stock muffler with an exhaust gas outlet comprising:

A. a modification system muffler, said modification system muffler being an efficient super quiet high flow rate muffler, having an exhaust gas inlet and an exhaust gas outlet, B. a first exhaust pipe for connecting the exhaust gas outlet of the stock muffler to the exhaust gas inlet of said modification system muffler, C. a second exhaust pipe having first and second ends, said first end of said second exhaust pipe connected to the exhaust gas outlet of said modification system muffler, said second end of said second exhaust pipe facing downward, D. a least one clamp for supporting said modification system muffler on said all terrain vehicle, such that said modification system muffler extends across the back of said all terrain vehicle and is generally perpendicular to said stock muffler, and E. clamps for securing said first and second ends of said first exhaust pipe to said stock muffler outlet and said modification system muffler inlet respectively, and a clamp for securing the first end of said second exhaust pipe to said exhaust gas outlet of said modification system muffler, whereby the exhaust noise of said all terrain vehicle is reduced, and the likelihood of hot particles being emitted to the atmosphere in the exhaust gas is reduced, without adversely affecting the performance of the engine.

2. The exhaust modification system for an all terrain vehicle of claim 1, wherein at least one said first and second exhaust pipes are formed of flexible pipe.

3. The exhaust modification system for an all terrain vehicle of claim 1, wherein said first and second exhaust pipes are formed of flexible pipe.

4. The exhaust modification system for an all terrain vehicle of claim 1, further comprising an adapter having a cylindrical flange and cylindrical pipe extension extending therefrom, said adapter being mounted on the stock muffler, with the cylindrical pipe aligned with the exhaust gas outlet.

5. The exhaust modification system for an all terrain vehicle of claim 1, wherein said at least one clamp for supporting said modification system muffler is comprised of a u-bolt and a saddle sized to fit around said modification system muffler.

6. The exhaust modification system for an all terrain vehicle of claim 1, wherein said modification system muffler has an elongated cylindrical shape formed by a cylindrical side wall and first and second ends, with an inlet on a cylindrical sidewall of said muffler near said first end of said muffler, and an outlet on said second end of said muffler.

7. An exhaust modification system for an all terrain vehicle having a stock muffler with an exhaust gas outlet facing toward the rear of the vehicle, comprising:

A. a modification system muffler having an elongated body with first and second ends, said modification system muffler being an efficient super quiet high flow rate muffler having an exhaust gas inlet located at said first end of said muffler and an exhaust gas outlet located at said second end of said muffler, B. a first exhaust pipe, having first and second ends, for connecting the exhaust gas outlet of the stock muffler to the exhaust gas inlet of said modification system muffler, C. a second exhaust pipe having first and second ends, said first end of said second exhaust pipe connected to said exhaust gas outlet of said modification system muffler, D. a least one support device for supporting said modification system muffler on said all terrain vehicle with said exhaust gas inlet and said exhaust gas outlet facing toward opposite sides of the all terrain vehicle, said modification system muffler extending across the back of said all terrain vehicle and being generally perpendicular to said stock muffler, whereby the exhaust noise of said all terrain vehicle is reduced, and the likelihood of hot particles being emitted to the atmosphere in the exhaust gas is reduced, without adversely affecting the performance of the engine.

8. The exhaust modification system for an all terrain vehicle of claim 7, wherein at least one said first and second exhaust pipes are formed of flexible pipe.

9. The exhaust modification system for an all terrain vehicle of claim 7, wherein at least of portion of said first and second exhaust pipes are formed of flexible pipe.

10. The exhaust modification system for an all terrain vehicle of claim 7, wherein said first exhaust pipe includes a right angle bend.

11. The exhaust modification system for an all terrain vehicle of claim 7, wherein said second exhaust pipe includes a right angle bend.

12. The exhaust modification system for an all terrain vehicle of claim 11, wherein said second end of said second exhaust pipe faces downward.

13. The exhaust modification system for an all terrain vehicle of claim 7, further comprising an adapter having a flange and cylindrical pipe extension extending therefrom, said flange being mounted on the stock muffler, with the cylindrical pipe aligned with the exhaust gas outlet and said cylindrical pipe extension is connected to said first end of said first exhaust pipe.

14. The exhaust modification system for an all terrain vehicle of claim 7, wherein said at least one support device for supporting said modification system muffler is comprised of a u-bolt and a saddle sized to fit around the elongated body of said modification system muffler.

15. The exhaust modification system for an all terrain vehicle of claim 7, wherein the elongated body of said modification system muffler has a cylindrical shape, with an inlet on a cylindrical sidewall of said muffler near said first end of said muffler, and an outlet at said second end of said muffler.

16. The exhaust modification system for an all terrain vehicle of claim 7, including an adaptor to connect said modification system to the exhaust gas outlet of the stock muffler.

17. An exhaust modification system for an all terrain vehicle, having a stock muffler with an exhaust gas outlet facing toward the rear of the vehicle, comprising:

A. a modification system muffler having an elongated body with first and second ends facing toward opposite sides of the vehicle, said modification system muffler being an efficient super quiet high flow rate muffler, an exhaust gas inlet located near said first end of said muffler, and an exhaust gas outlet at said second end of said muffler, B. a first exhaust pipe for connecting the exhaust gas outlet of the stock muffler to the exhaust gas inlet of said modification system muffler, C. a second exhaust pipe having first and second ends, said first end of said second exhaust pipe connected to the exhaust gas outlet of said modification system muffler, said second end of said second exhaust pipe facing downward, D. at least one support device for supporting said modification system muffler on said all terrain vehicle, wherein said modification system muffler is supported on said all terrain vehicle such that the elongated body extends across the back of said all terrain vehicle and is generally perpendicular to said stock muffler, whereby the exhaust noise of said all terrain vehicle is reduced, and the likelihood of hot particles being emitted to the atmosphere in the exhaust gas is reduced, without adversely affecting the performance of the engine.

18. The exhaust modification system for an all terrain vehicle of claim 17, wherein at least a portion of one said first and second exhaust pipes is formed of flexible pipe.

19. The exhaust modification system for an all terrain vehicle of claims 17, further comprising an adapter having a flange and cylindrical pipe extension extending therefrom, said flange being mounted on the stock muffler, with the cylindrical pipe aligned with the exhaust gas outlet of the stock muffler.

20. The exhaust modification system for an all terrain vehicle of claim 17, comprising an adapter for connecting said exhaust gas outlet of the stock muffler to the exhaust gas inlet of said modification system muffler.

21. The exhaust modification system for an all terrain vehicle of claim 17, wherein said at least one support device for supporting said modification system muffler is comprised of a u-bolt and a saddle sized to fit around the elongated body of said modification system muffler.

22. The exhaust modification system for an all terrain vehicle of claim 17, wherein the elongated body of said modification system muffler is of a cylindrical shape with an inlet on a cylindrical sidewall of said muffler near said first end of said muffler, and an outlet at said second end of said muffler.

* * * * *